United States Patent [19]

Furrow

[11] Patent Number: 5,015,203

[45] Date of Patent: May 14, 1991

[54] POWER DISTRIBUTION UNIT HAVING IMPROVED JUNCTION BOX

[75] Inventor: Randy M. Furrow, Kernersville, N.C.

[73] Assignee: AMP Incorporated, Harrisburg, Pa.

[21] Appl. No.: 456,920

[22] Filed: Dec. 26, 1989

[51] Int. Cl.[5] ..... H01R 13/73

[52] U.S. Cl. ..... 439/535; 439/557

[58] Field of Search ..... 174/53, 58; 439/357, 439/535, 536, 538, 539, 640, 654, 552, 555, 557, 560

[56] References Cited

U.S. PATENT DOCUMENTS

| | | | |
|---|---|---|---|
| 3,573,716 | 4/1971 | Garver | 439/557 |
| 4,634,212 | 1/1987 | Boundy et al. | 439/535 |
| 4,681,386 | 7/1987 | Boulanger | 439/557 |
| 4,711,507 | 12/1987 | Noorily | 439/557 X |
| 4,740,167 | 4/1988 | Millhimes et al. | 439/92 |
| 4,909,759 | 3/1990 | Fitzgerald et al. | 439/557 X |

OTHER PUBLICATIONS

Brochure entitled "AMP Products for the Office of the 80's and Beyond".

*Primary Examiner*—Neil Abrams
*Assistant Examiner*—Khiem Nguyen
*Attorney, Agent, or Firm*—Bruce J. Wolstoncroft

[57] ABSTRACT

Junction box assembly comprises a housing having a plurality of identical elongated bus bars therein. Each of the bus bars has parallel side edges and ears extending alternately from each of the side edges, the ears being staggered from one side edge to the other. The ears constitute receptacles on the bus bar so that spaced apart receptacles are formed which face in opposite directions. The bus bars and the housing have polarizing surfaces which ensure placement of the bus bars in the housing in a predetermined orientation. The housing which houses the bus bars has latching members located on the outer surface thereof, where the latches comprises interlocking tongues and grooves, which provides for cooperation between the two latching arms.

5 Claims, 9 Drawing Sheets

POWER DISTRIBUTION UNIT HAVING IMPROVED JUNCTION BOX

FIELD OF THE INVENTION

This invention relates to power distribution units or assemblies of the type used in the wiring systems for buildings and particularly to improvements to the latching structure of the junction box assemblies of such distribution units.

BACKGROUND OF THE INVENTION

Description of the Prior Art

It is now common practice to provide electrical services to buildings by means of wiring systems of the type described in U.S. Pat. No. 4,740,167, incorporated herein by reference. Wiring systems of the type described in that patent specification comprise electrical cables having connectors on their ends, junction boxes, and duplex receptacles which are plugged into the junction boxes. The junction boxes contain a plurality of bus bars which are connected to the conductors in the cable when the connectors on the cable ends are coupled to the junction boxes. The bus bars in turn have integral receptacles for tab terminals so that when the duplex receptacles are plugged into the junction box, the bus bars are connected to the outlet receptacles in the duplex receptacles. It is common practice to locate these junction boxes in walls or panels, in particular, in cutout openings within sheet metal walls.

In U.S. Pat. No. 4,634,212, a junction box of the type mentioned above is shown which includes latching features having latching fingers which project one towards the other to form two opposed contacts. The fingers, when in there open state are larger than a cutout in the panel, and when pushed towards the opening, they can contract to place the junction box within the opening. When the junction box is in its centered position within the panel, the fingers open up once again and trap the panel intermediate the fingers.

It has been found that, while this type of system is useful for latching the junction box to a panel, can be difficult to remove. When trying to remove the junction box from the panel, it is difficult to remove the junction box to the same side of the panel. In other words, when one deflects the latch fingers on the same side as one is located, the junction box can be easily pushed through the panel, although, the junction box is now located on the opposite side of the panel. To remove the junction box and keep it on the same side requires that one can deflect the inner latches and pull the box through at the same side, testing one's dexterity and coordination.

The object of the invention then is to design a junction box connection system where the latching structure permits easy installation and removal from one side of the panel.

SUMMARY OF THE INVENTION

The object of the invention was accomplished by designing an electrical connector member for mounting in a panel cutout, the connector having at least two arms extending from a housing means and projecting towards each other, the arms having end surfaces spaced apart to locate the panel therebetween, when the connector is mounted in the panel. The connector of the present invention is characterized in that the arms which face each other are operatively connected one to the other, such that deflection of one of the said arms causes the movement of the other said arms to install or remove the connector from the panel.

BRIEF DESCRIPTION OF THE DRAWINGS

FIG. 3 is a perspective view showing the parts of the junction box, except the bus bars, exploded from each other.

THE PREFERRED EMBODIMENT OF THE INVENTION

Figure 1:
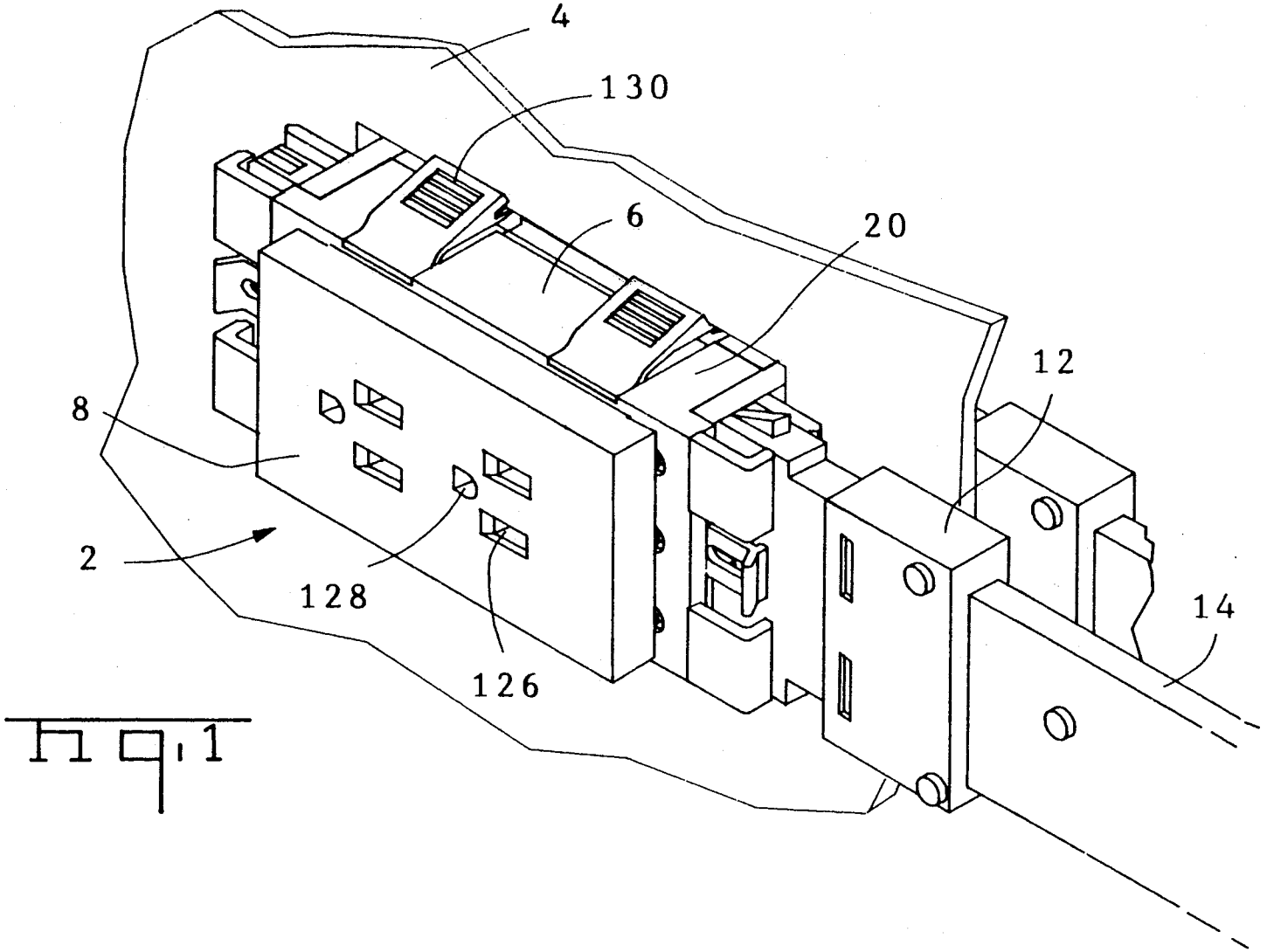
FIG. 1 is a perspective view of a power distribution assembly mounted in a wall panel.
Figure 2:
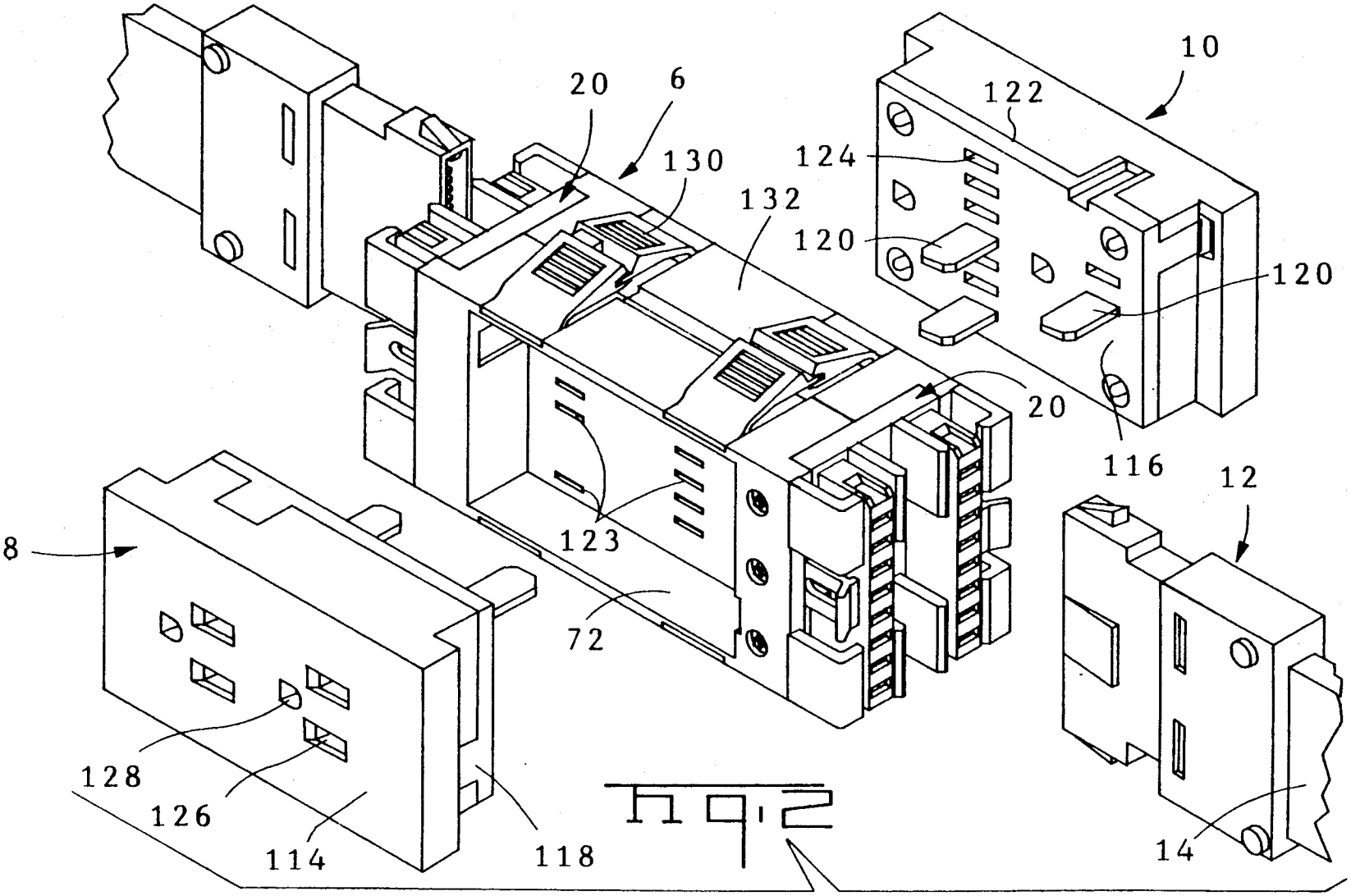
FIG. 2 is a view showing the components of the power distribution assembly exploded from each other.
Figure 1:
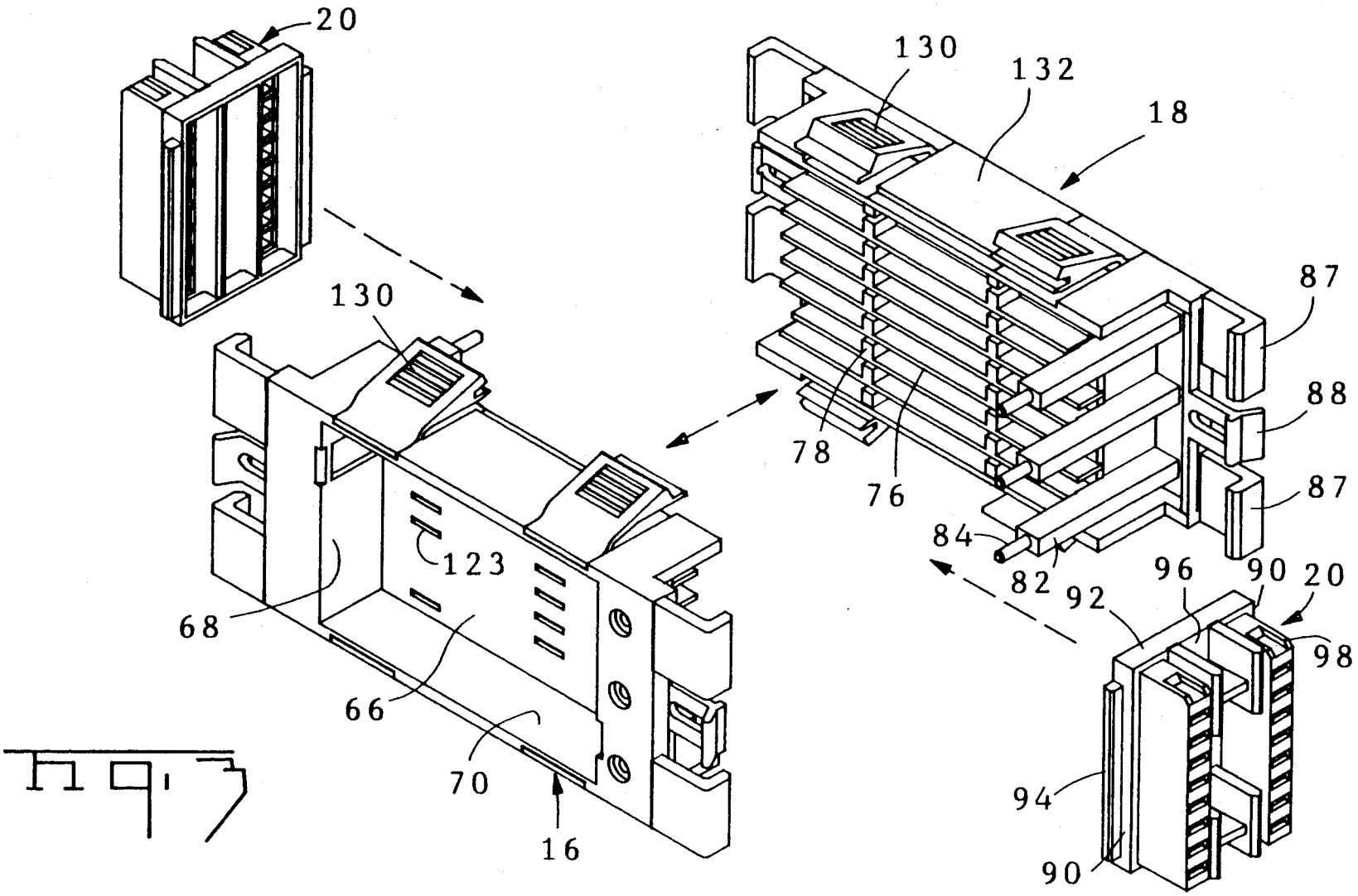

FIGS. 1 and 2 show a power distribution assembly 2 mounted in a panel 4 to provide electrical service on each side of the panel. The power distribution assembly 2 comprises a junction box assembly 6, two duplex receptacle assemblies 8, 10, and connectors 12 which are installed on the ends of electrical cables 14.

Figure 4:
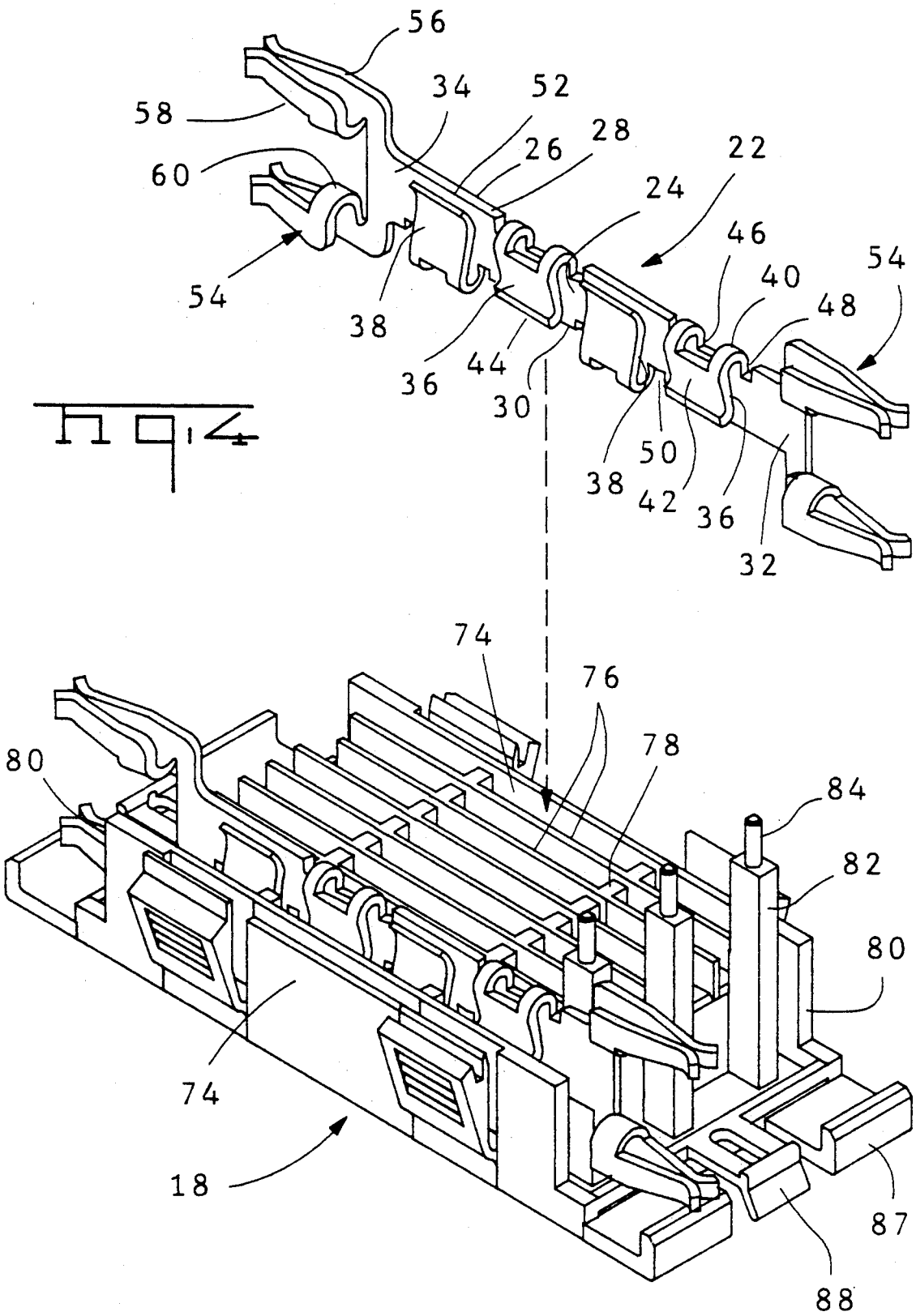
FIG. 4 is a view showing one of the sections of the junction box housing with a bus bar exploded from the housing.

The junction box assembly 6, FIGS. 3–7, comprises a housing composed of two housing parts 16, 18, two end caps 20, and eight bus bars 22. As shown in FIG. 4, the bus bars are stamped and formed sheet metal members, each of which has first and second side surfaces 24, 26, first and second edges 28, 30, and ends 32, 34. Two ears 36 extend from the first side edge 28 and two ears 38 extend from the second side edge 30, all of the ears extending laterally across the first side surface 24. The ears are staggered so that the two ears 38 extend upwardly while the two ears 36 project downwardly, as viewed in FIG. 4. Each ear is reversely bent adjacent to its associated side edge to form a bight 40, an intermediate portion 42 which extends obliquely towards the side surface, and a free end 44. Each ear is bent adjacent to its free end so that the free end 44 extends obliquely away from the side surface thereby to provide lead-in surface portions for a terminal tab as will be described below.

Each ear has an opening 46 in its bight 40 and notches 48, 50 on each side of the bight, the notches 48 being in the first edge 28 and the notches 50 being in side edge 30. The openings 46 and the notches 48, 50 are provided for the purpose of controlling the spring characteristics of the ears.

Figure 6:
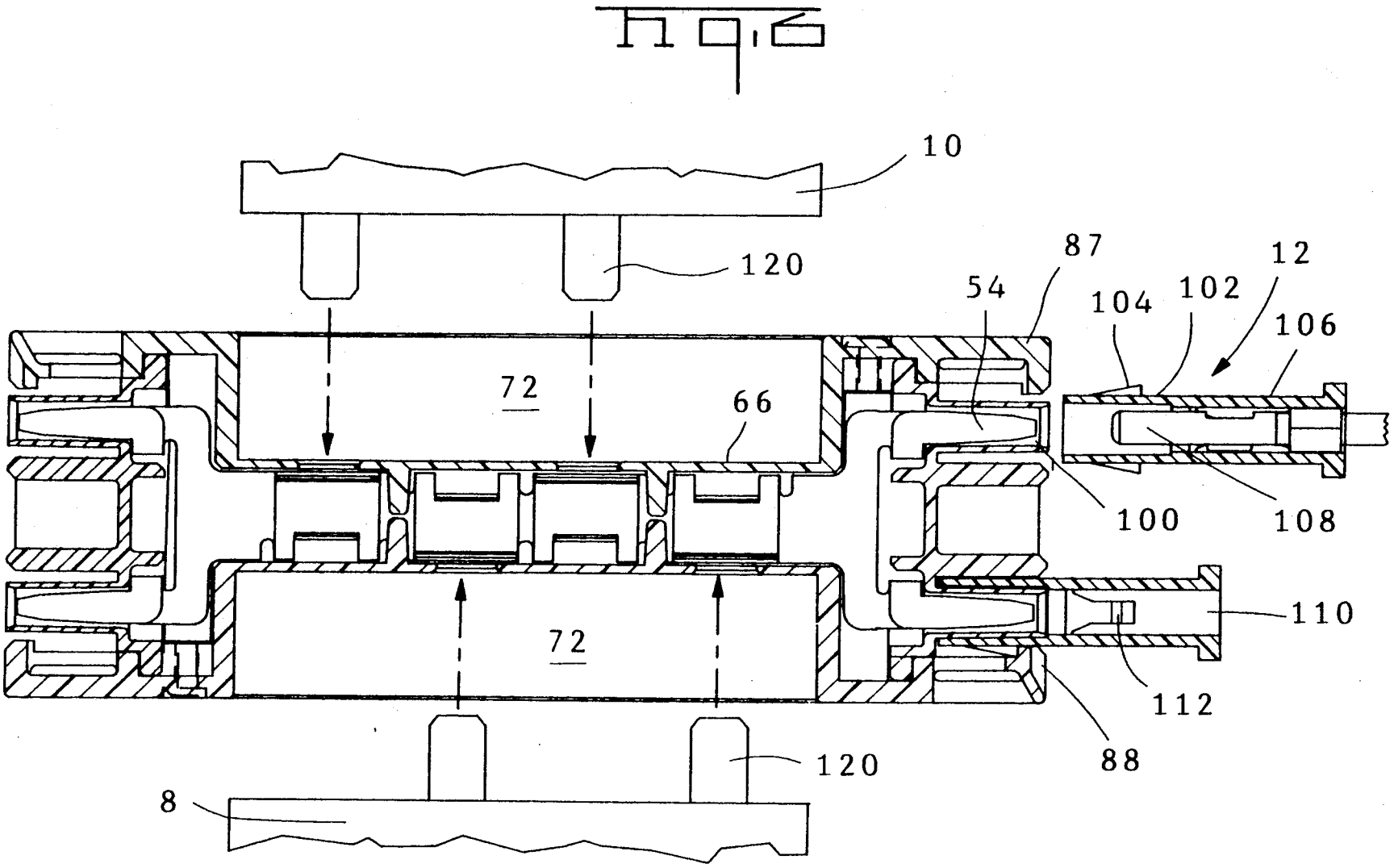
FIG. 6 is a view similar to FIG. 5 but showing the housing parts assembled to each other and showing portions of duplex receptacles and connectors on the ends of cables.

Each receptacle has a terminal receiving end 52 at the free end of its ear. As shown in FIG. 6, a tab terminal can be coupled to the receptacle by moving the tab into the space between the ear and the adjacent surface portions of the sidewall 24. It will thus be apparent that each bus bar is capable of receiving two terminal tabs on its upper or first side edge 28 and two terminal tabs on its lower side edge 30 and all of these entrance portions 52 for the terminal tabs are in predetermined locations on the bus bar.

Each bus bar has two additional receptacles 54 extending from each of its ends 32, 34. Each of these additional receptacles comprises coextensive and convergent arms 56, 58 which are connected to each other by a folded section 60. These additional receptacles receive tab terminals contained in the connectors as shown in FIG. 6.

The two junction box housing parts 16, 18 are identical and the same reference numerals will therefore be used to identify corresponding structural parts of the two housing sections.

Figure 5:
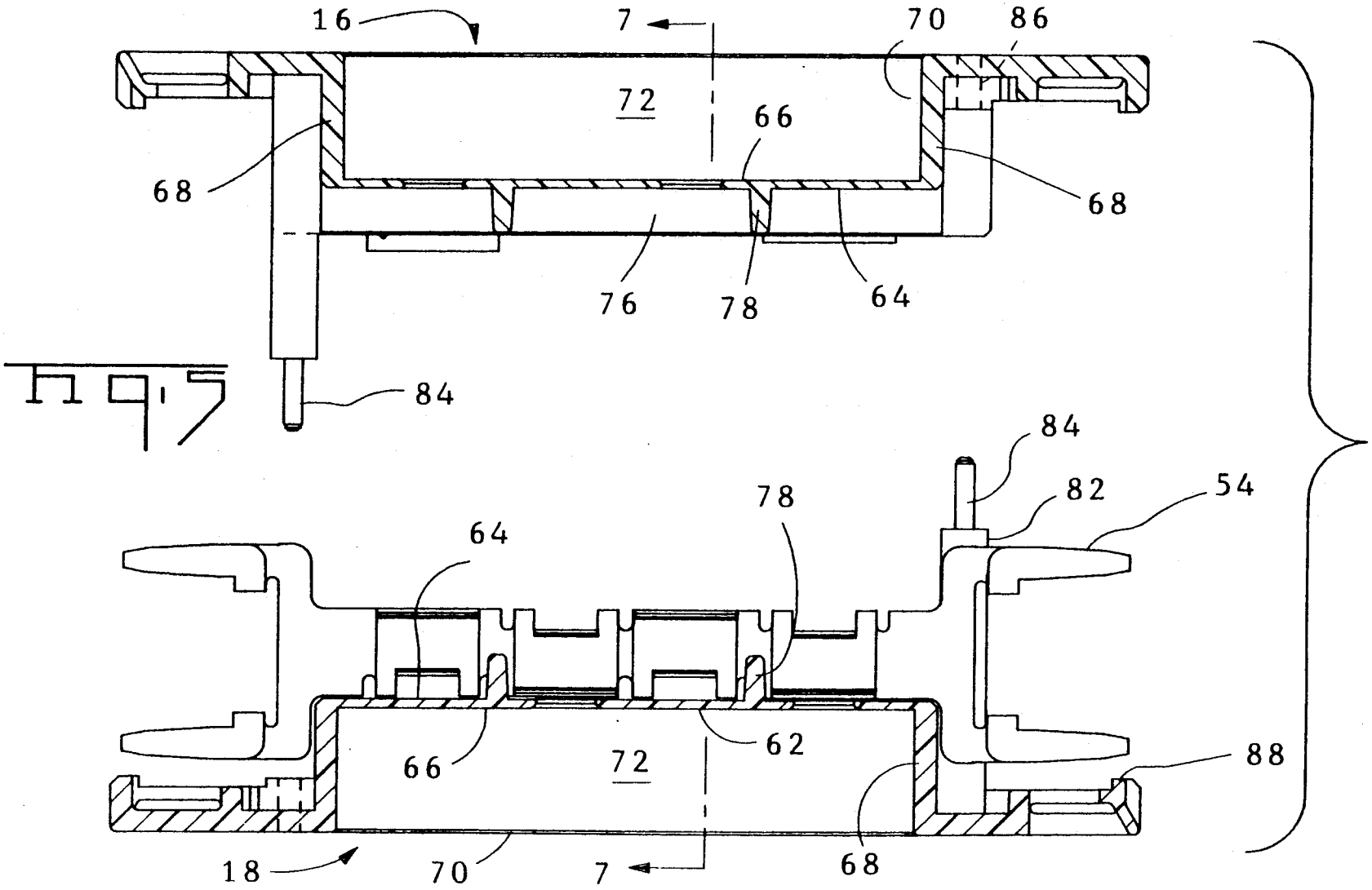
FIG. 5 is a sectional side view showing the two parts of the junction box housing in aligned spaced apart relationship and showing a bus bar in one of the housing parts.
Figure 7:
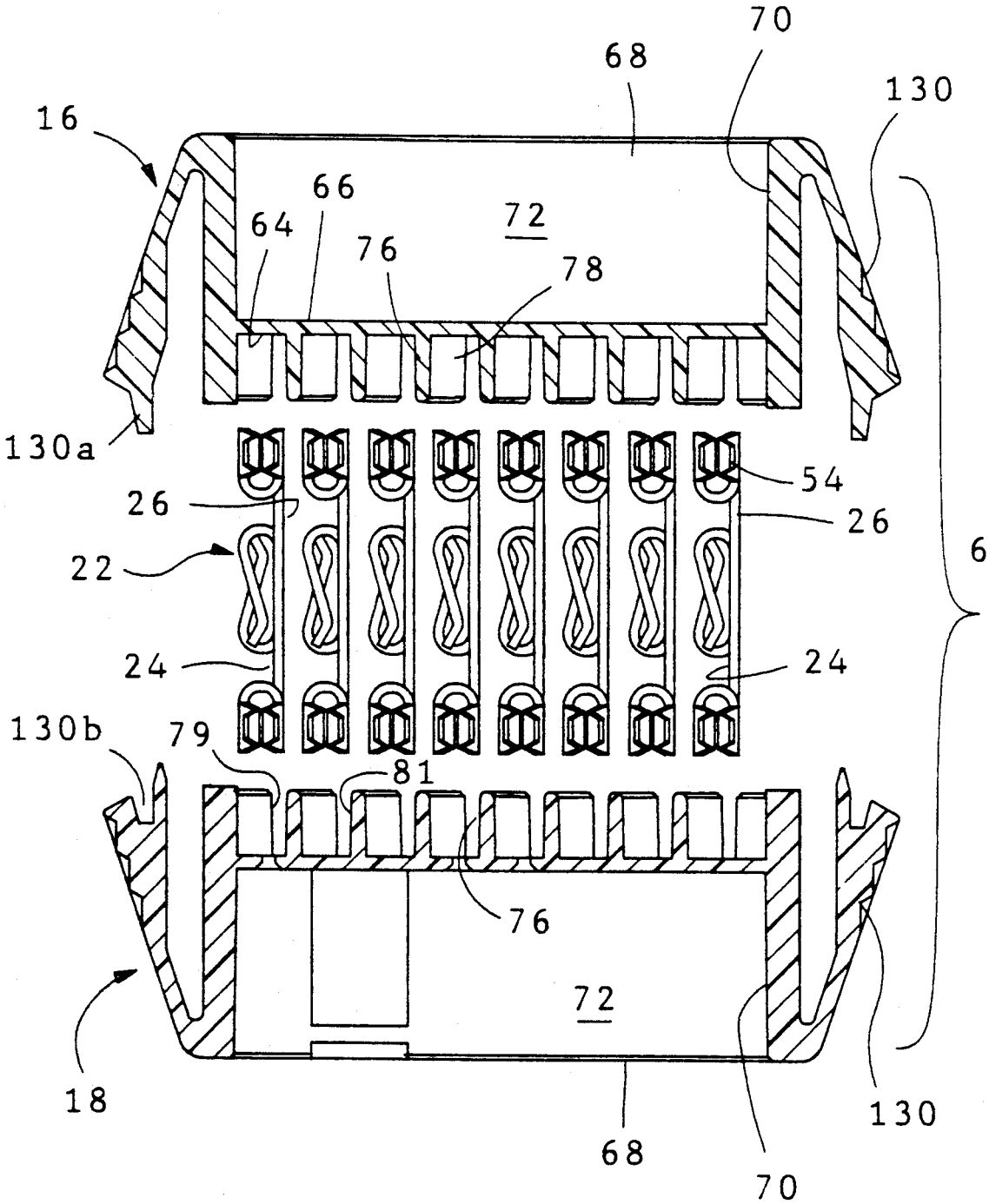
FIG. 7 is a sectional view looking in the direction of the arrows 7—7 of FIG. 5 but with all of the bus bars exploded from the junction box housing sections.
Figure 9:
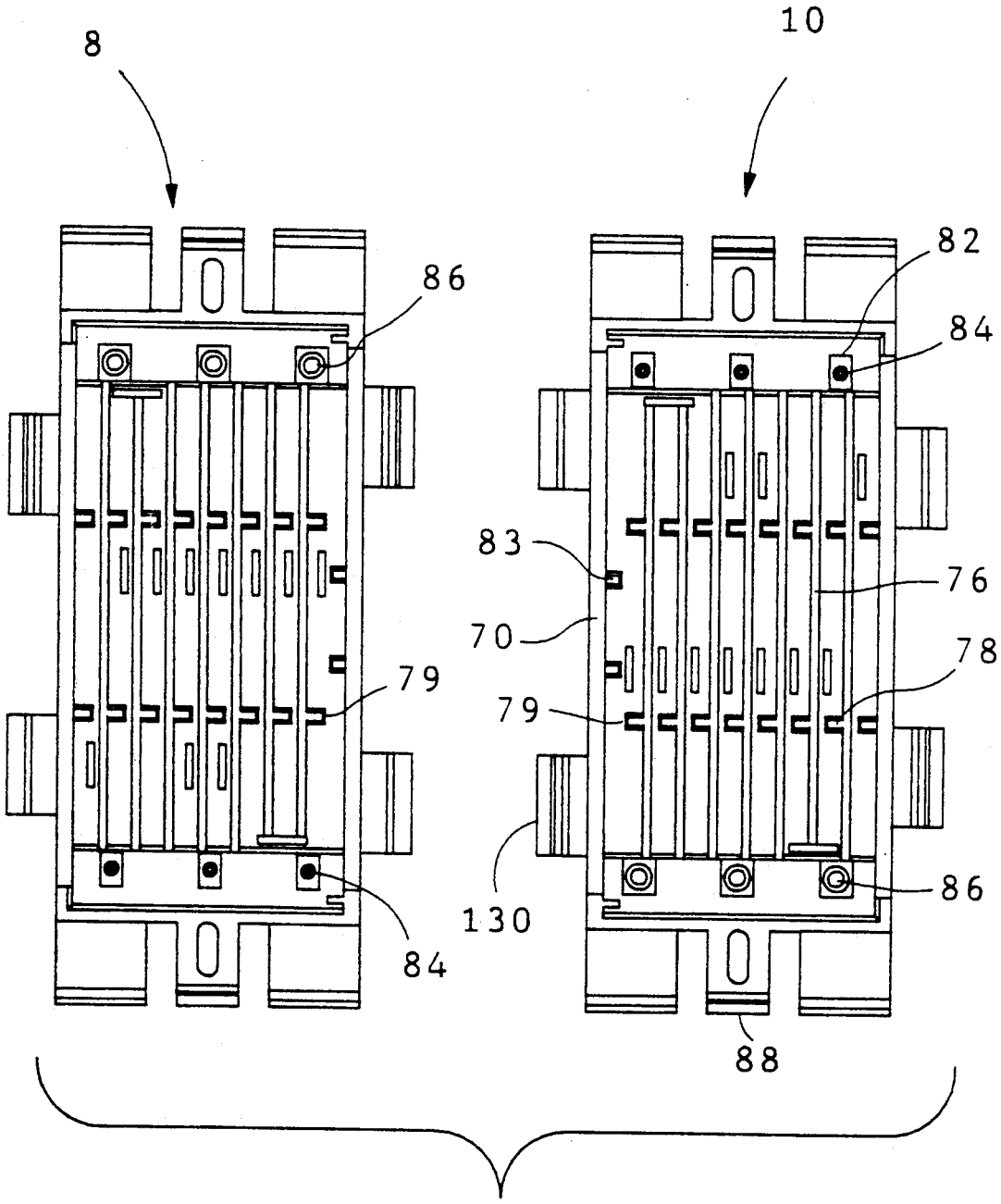
FIG. 9 is a plan view of the internal surfaces of the junction box sections.

Referring to FIGS. 4 and 5, each housing part comprises a rectangular panel 62 having an internal surface 64 and an external surface 66. End walls 68 and side walls 70 surround the external surface 66 so that a recess 72 is defined for reception of portions of the duplex receptacles. Portions 74 of the side walls 70 extend beyond the internal surface 64 of the panel and a plurality of parallel barrier walls 76 extend between the ends of the housing part. The barrier walls 76 and the portions 74 of the sidewalls define side-by-side stalls for the bus bars. Ribs 78 extend laterally from the barrier walls. As shown in FIGS. 7 and 9, the ribs 76 have ends 79 which are spaced from the surface 81 of the next adjacent barrier wall 76 by a distance which is slightly greater than the thickness of a bus bar as measured between the side surfaces 24, 26. When a bus bar is inserted into one of the stalls between adjacent barrier walls, the bus bar must be in an orientation such that the surface 26 will be opposed to the surface 81 of the next adjacent barrier wall after the bus bar has been inserted. The ribs are received between adjacent ears on the bus bar when the bus bar is positioned in a stall. Polarization is thus achieved by the ribs, the location of the ears, the spacing between the ears, and the thickness of the bus bar.

Two ribs 83 are provided on the internal surface of one of the sidewalls 70, as shown in FIG. 9. The ribs 83 are required for the reason that the stall into which these ribs project is somewhat wider than the other stalls in the housing sections. The ribs 83, in effect, reduce the width of the end stalls so that the bus bars can be inserted only when they are in the desired orientation.

Three aligning members 82 extend from each of the housing parts adjacent to the ends 80 of the side walls. Each of these aligning members has a reduced diameter cylindrical end portion 84 which is received in an opening 86 in the other housing part as shown in FIGS. 5 and 6. A central latch ear 88 extends from each end of each housing part and is between two fixed extensions 87. The latch ear 88 cooperates with a fixed latch ear on one of the connectors and the fixed ears 87 support the side surfaces of the connectors when the connectors are coupled to the junction box.

Each of the rectangular end caps 20 has opposite upper and lower ends 92 as viewed in FIG. 3 and opposite sides 90. Ribs 94 extend from the sides 90 and are received in recesses in the housing parts 16, 18 which recesses are adjacent to the fixed ends of the ears 87, 88. A pair of spaced apart terminal housings 98 project from the external surface 96 of each end cap and have cavities 100 therein, FIG. 6, which receive the receptacles 54 at the ends of the bus bar.

Each of the connectors 12 has a housing 106 from which a rectangular hood 102 projects, the hood being dimensioned to fit over one of the housing projections 98 on the end caps. Latch ears 104 are provided on the side walls of each housing for cooperation with the previously identified flexible latch ears 88 on the housing parts. The conductors in the cable have terminals on their ends which are mounted in cavities 110 in the connector housing. Each terminal has a blade portion 108 which projects into the rectangular hood 102 so that when the connector is coupled with one of the housing enclosures on the end cap, the blade will be moved through slots in the end cap enclosure and be coupled to one of the receptacles 54 in a bus bar. The cavities in each connector have conventional retaining means as shown at 112 for retaining the terminals in the connector housings.

Each of the duplex receptacles 8, 10 has an external face 114, an internal face 116, and a reduced width portion 118 which is dimensioned to be received in one of the recesses 72 of the housing parts, as shown in FIG. 2. The internal face comprises a cover plate 122 having slots 124 therein through which blade terminals 120 project. The blade terminals 120 in turn extend from stamped and formed conductors which are contained in the duplex receptacle and which have receptacle portions which are in alignment with openings 126, 128 in the external face of the receptacle.

Reference is made to the above-identified U.S. Pat. No. 4,740,167 for teachings of the structures of the conductors from which the tabs 120 extend. As shown in that U.S. patent, different types of conductors are supplied having their tabs in any one of several positions relative to the receptacles on the conductors which are in alignment with the openings 126, 128 in the face 114 of the receptacle. The precise configuration of the conductors selected for a particular duplex receptacle 8 or 10 will depend upon which conductors in the cable 14 are to be tapped at or in a particular duplex receptacle. The openings 123 in the external surface of the panel are provided at all of the possible locations which are required to establish contact with any one of the contacts 36 or 38, and thus any one of the conductors in the cable. These openings 123 are in alignment with the tab receiving ends of the individual receptacles in the bus bar. Similarly, openings 124 are provided on the internal faces 116 of the duplex receptacles in all of the locations which are required to establish contact with any one of the bus bars. In a particular duplex receptacle, only three of the openings 124 will be occupied by projecting tabs 120.

The housing assembly is mounted in the panel by means of mounting ears 130 which extend from the side surfaces 132 of the housing parts obliquely towards each other. After a junction box assembly has been installed in a panel 2, the required number of connectors can be coupled to the junction box at one or both ends thereof.

According to the teaching herein, the bus bars are identical and there is no necessity, when the junction box is assembled, to locate a bus bar of a particular configuration in a particular stall or position in the housing. Furthermore, by virtue of the fact that the bus bars are polarized relative to the housing sections 16, 18, the bus bars can be installed in the housing assembly in only the required orientation. The fact that all of the bus bars are identical results in significant manufacturing economies and in addition, results in economies in assembly. If the bus bars are assembled by unskilled labor, there is no necessity of instructing the installer as to which bus bars occupy which positions and the installer will always be required to install the bus bars in their proper positions by virtue of the polarization feature. A further advantage is achieved in that the barrier walls 76 extending from the internal surface 64 of the panel are all parallel to each other and are similar to each other in both parts of the housing assembly, although the ribs 78 must be offset from each other as noted above. The structure of the moulding is thus simplified as compared with prior art devices with a resulting reduction in tooling costs.

The fact that all of the bus bars are identical and are installed in the same orientation in the housing will permit the use of automatic assembly machinery or robots in installing the bus bars in the housing assembly and in assembling the parts of the housing assembly to each other.

To assemble the junction box of the disclosed embodiment, the bus bars 22 are all inserted within the defined slots, as shown in FIG. 4. The end caps are then inserted over the opposed contact ends 54. The other half of the junction box can now be installed over the half having contacts already inserted therein. It should be noted that the housing halves are identical with each housing half having posts 82 at one end, and apertures 86 at the opposite end. The housing halves are assembled by placing the posts 84 of one of the halves into the apertures 86 of the opposite half, which causes the opposite posts 84 to extend through the opposite apertures 86. The posts are profiled such that when fully inserted, they extend beyond the front face of the housing halves. The ends of the posts are now heat staked from each side which retains the two housing halves together.

Figure 8:
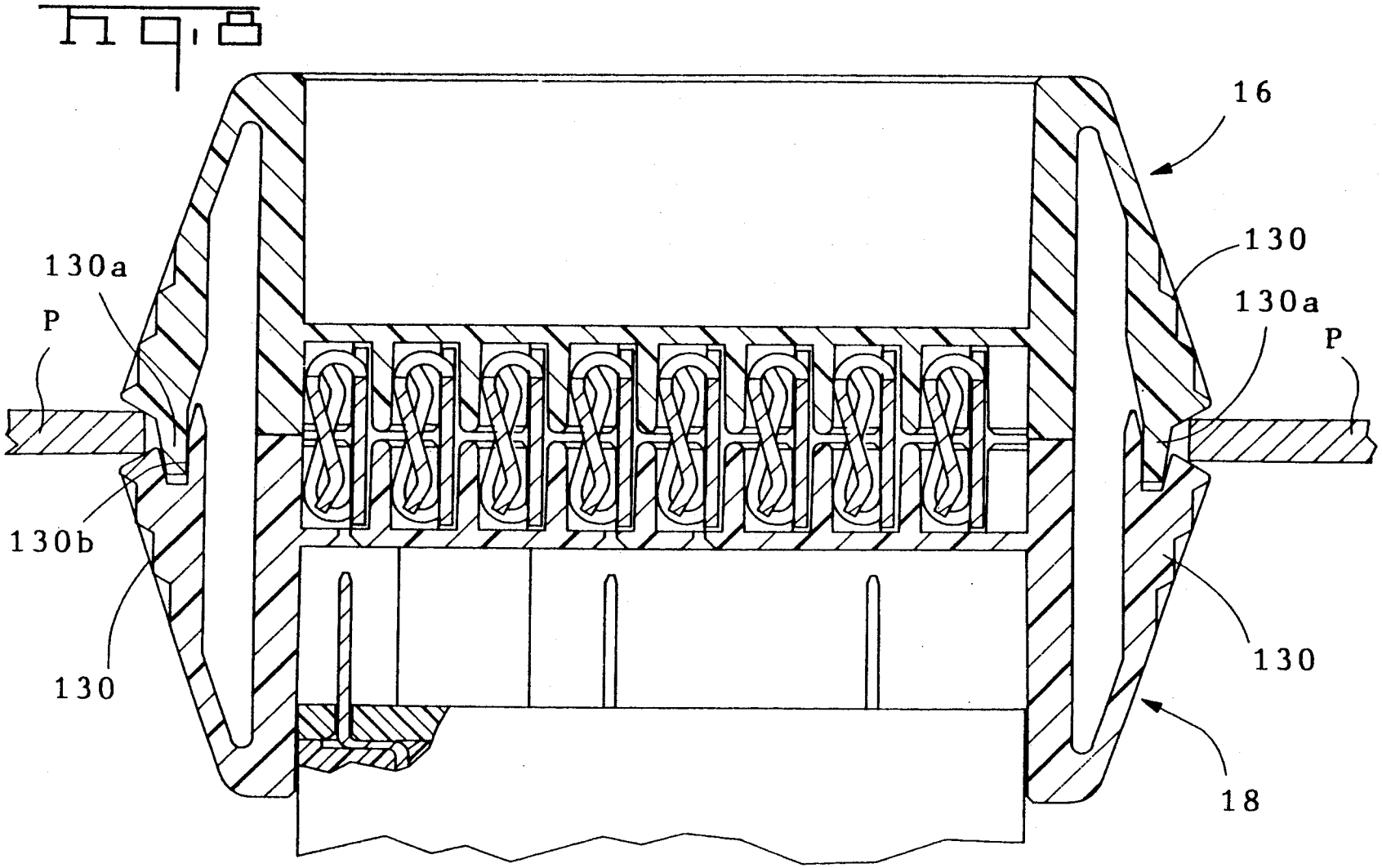
FIG. 8 is a view similar to FIG. 7 but showing the junction box sections in assembled relationship.

It should be noted from FIG. 7, that when the two housing halves 16, 18 are placed together, the two latch arms 130 are interconnected together via and tongue 130*a* and groove 130*b* arrangement. Thus as shown in FIG. 8, when the junction box is to placed within a panel, the arms 130 are deflected towards the housing body, and whichever arm 130 is deflected, the other other arm 130 on the opposite side of the panel follows, due to the interengagement between the tongue and groove. Thus the junction box is easily installed and removed into and out of the panel.

I claim:

1. An electrical connector member for mounting in a panel cutout, the connector having at least two arms extending from a housing means, said arms being laterally aligned with each other and projecting towards each other, the arms having end surfaces spaced apart to locate the panel therebetween, when the connector is mounted in the panel, the connector being characterized in that:

the arms which face each other are operatively connected one to the other, one of said arms having a tongue while the other of said arms having a groove, where the tongue of the one said arm extends into the groove of the other said arm, such that deflection of one of the said arms causes the movement of the other said arm to install or remove the connector from the panel.

2. The connector of claim 1 characterized in that the housing means comprises two bipartite housing parts having an upper and lower edge, where at least one latch arm extends from both the upper and lower edge of each housing part, to from upper and lower cooperating latches.

3. An electrical power distribution connector for mounting in a panel opening, the connector comprising:

a junction box having front and rear faces, upper and lower faces, and said faces, said junction box having a plurality of electrical conductor means extending between said side faces, and electrical receptacles positioned on said front and rear faces and electrically connected on said front and rear faces and electrically connected to said conductor means, said junction box comprising two identical housing parts having cooperative latching means positioned on said upper and lower faces for latchable attachment within the opening of the panel, said latching means comprising at least one latch arm extending from each said identical housing part, where each latch arm has a shoulder proximate to a free end of said arm, said arms being laterally aligned with said shoulder being spaced apart to receive the panel between said shoulder, each said latching arm being cooperatively connected to an associated latching arm for movement therewith, said latching arms being resiliently deflectable towards said upper and lower faces of said junction box to release said latching arms from the opening.

4. The connector of claim 3, wherein each said shoulder is beveled, thereby defining a flared opening with said associated latch arm.

5. The connector of claim 3, wherein one of said latch arms includes a tongue and said associated latch arm includes a groove adapted to receive said tongue.

* * * * *